United States Patent [19]

Rogers

[11] 4,016,698

[45] Apr. 12, 1977

[54] BRACING FOR STUD WALLS

[75] Inventor: Delmar R. Rogers, Shakopee, Minn.

[73] Assignee: United Steel Products Co., Montgomery, Minn.

[22] Filed: June 30, 1975

[21] Appl. No.: 591,875

Related U.S. Application Data

[63] Continuation-in-part of Ser. No. 447,296, March 1, 1974, abandoned.

[52] U.S. Cl. ..... 52/656; 52/693

[51] Int. Cl.[2] ..... E04C 2/38; E04C 3/18

[58] Field of Search ..... 52/633, 657, 693, 695, 52/696, 656

[56] References Cited

UNITED STATES PATENTS

| | | | |
|---|---|---|---|
| 1,523,711 | 1/1925 | Powell | 52/695 |
| 1,649,226 | 11/1927 | Gstalder | 52/695 |
| 2,302,101 | 11/1942 | Boydstun | 52/657 |
| 2,389,573 | 11/1945 | Balduf | 52/657 |
| 2,442,726 | 6/1948 | Gstalder | 52/695 |
| 2,565,875 | 8/1951 | Musacchia | 52/695 |
| 2,624,080 | 1/1953 | Eichenlaub | 52/695 |
| 2,856,646 | 10/1958 | Latimer et al. | 52/693 |
| 2,865,059 | 12/1958 | Scriven | 52/688 X |
| 2,963,127 | 12/1960 | Manville | 52/105 |
| 2,964,807 | 12/1960 | Kennedy | 52/696 |
| 3,049,764 | 8/1962 | Kawalle | 52/695 |
| 3,332,196 | 7/1967 | Tuttle | 52/696 |
| 3,591,997 | 7/1971 | Tennison, Jr. | 52/657 |

*Primary Examiner*—Alfred C. Perham
*Attorney, Agent, or Firm*—H. Dale Palmatier

[57] ABSTRACT

A wooden stud wall having top and sole plates between which are fastened spaced, upright studs is provided with a brace comprising a metal strap oriented diagonally to the stud wall with the ends of the strap bent over and rigidly fastened as by nailing to respective upper and lower surfaces of the top and sole plates. The strap, which desirably is of 16 gauge steel, and about 2 inches in width, crosses the upright studs at an oblique angle at spaced points along the strap length. The strap may be fastened to the stud wall by nails driven through preformed holes in the strap ends, and may be fastened to the upright studs which it crosses by nails driven through spaced, preformed holes along the length of the strap.

3 Claims, 3 Drawing Figures

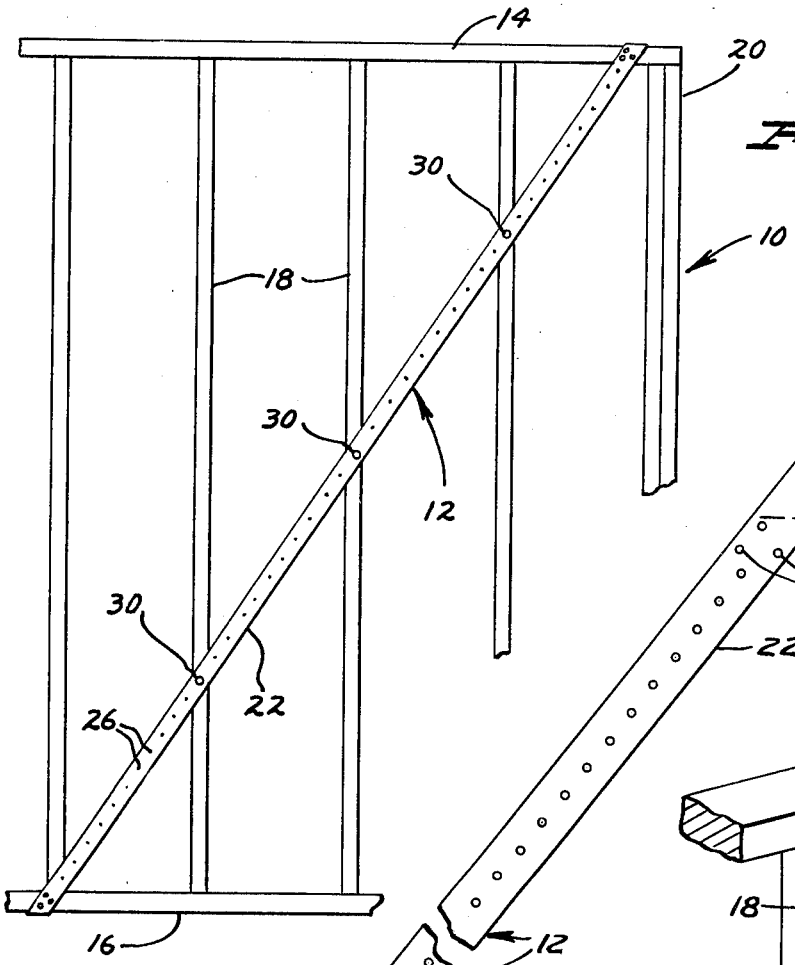
FIG. 1
FIG. 2
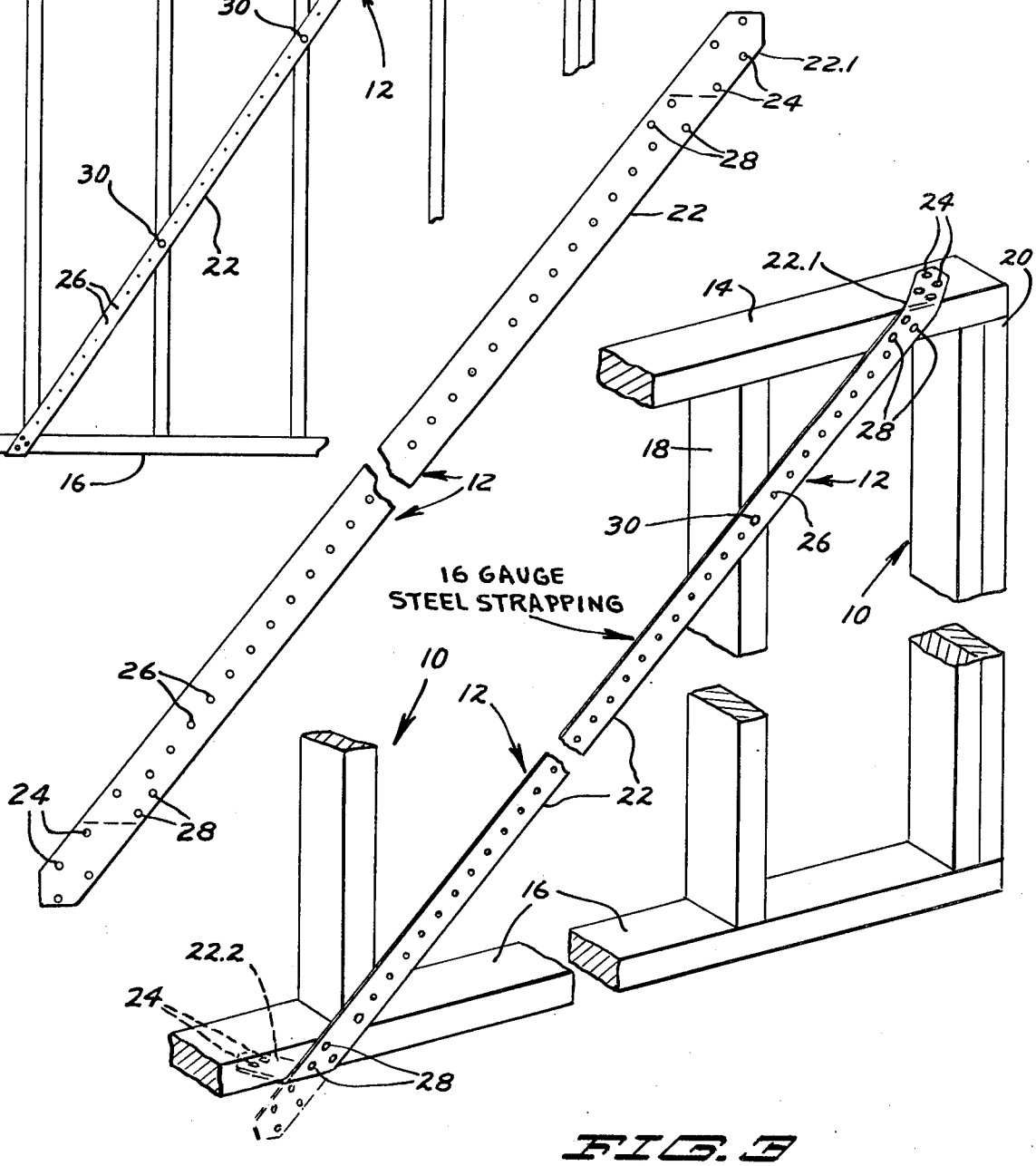
FIG. 3

BRACING FOR STUD WALLS

This is a continuation-in-part of application Ser. No. 447,296, filed Mar. 1, 1974 and now abandoned.

BACKGROUND OF THE INVENTION

In the building trade, it is common practice to support stud walls from sagging by affixing to the walls wooden "let-in" diagonal bracing. Because of the heavy loads often borne by stud walls in residential housing and the like, such walls are subjected to severe stresses which may produce sagging, or deformation of the walls. In addition, let-in bracing must be carefully cut and fitted to the stud wall which it is to support; a time-consuming operation. Diagonal metal strap bracing has been used in an effort to reduce the time required to brace stud walls and to reduce the space normally taken up by wooden let-ins, but such metal strap bracing in general is rather weak and fails readily. Such metal strap bracing is reported, for example, in U.S. Pat. Nos. 2,302,101 and 2,856,646. A less time-consuming, more easily installed and stronger metal strap bracing is much to be desired.

SUMMARY OF THE INVENTION

The present invention provides a wooden stud wall for a building or the like and a brace for the stud wall. A stud wall has vertically spaced top and sole plates between which are fastened spaced, upright studs. To the stud wall is fastened a brace comprising a metal strap which is oriented diagonally of the stud wall with the ends of the strap bent over and rigidly fastened to respective upper and lower surfaces of the respective top and sole plates. The strap crosses upright studs at an oblique angle at spaced points along the strap length. The strap may be provided with preformed holes through which nails are driven into the top and sole plates, and also desirably into the studs which are crossed by the metal strap, to positively affix the strap to the stud wall. The strap is desirably of steel and of suitable dimensions to permit it to be manually bent at its ends onto the upper and lower surfaces of the respective top and sole plates of the stud wall. The flattened nature of the strap, which snugly bears against the surface of the stud wall, reduces or eliminates interference by the strap with wall board or other material which subsequently may be mounted on the wall. The strength of the metal strap in tension, coupled with the wrap-around configuration of its ends, provides a brace which may greatly surpass in strength both wooden let-in bracing and metal strap bracing having at least one end not bent over and affixed to the upper or lower surface of the top or sole plate. Steel strapping of about 16 gauge and having a width of about 2 inches yields optimum results from the combined standpoints of economy, shipping ease, and stud wall strength.

DESCRIPTION OF THE DRAWING

FIG. 1 is a broken away view of the stud wall and brace of the invention showing the position of the brace on the stud wall;

FIG. 2 is a broken away view of the brace of the invention in configuration prior to bending of the ends of the brace; and FIG. 3 is a broken away view of the stud wall and brace of the invention showing the brace ends fastened to the stud wall plates, and phantom lines showing the position of the strap ends prior to bending about the stud wall plates.

DETAILED DESCRIPTION OF THE PREFERRED EMBODIMENT

With reference to the drawing, 10 and 12 designate generally a stud wall and the supporting brace which is fastened to the stud wall, respectively, in accordance with the present invention. The wooden stud wall, which may be made of 2 × 4 inch lumber nailed together in the usual fashion, includes a top plate 14 and a bottom plate 16 which are vertically spaced a distance of, for example, 8 feet. Between the top and sole plates are fastened spaced, upright studs 18. The ends of the stud wall may be finished with double end studs 20 or other appropriate structure. The edges of the top and sole plates 14 and 16 and of the studs 18 lie in the plane of the wall, and these edges are contacted by and fastened to the brace of the invention, as will be described below.

The brace 12 of the invention comprises an elongated flat metal strap 22, which is desirably of 16 gauge steel with a width dimension of about 2 inches. The width and thickness dimensions of the strap are desirably chosen so that the ends 22.1, 22.2 of the strap may manually be bent over the sharp edges of the top and sole plates. The ends of the strap are provided with preformed holes 24 through which nails may be driven for securing the strap to the stud wall plates 14, 16. In addition, the strap has a series of preformed holes 26 spaced along its length through which nails may be driven for affixing the strap to the edges of the studs 18 which are crossed by the strap. The length of the strap is chosen so that its ends 22.1, 22.2 extend above and below the respective top and sole plates of the stud wall when the strap is placed diagonally against the side of the stud wall, the strap forming an oblique angle with the studs 18. The strap ends 22.1, 22.2 which thus extend beyond the top and sole plates are of sufficient length so that when the strap ends are bent over the top and sole plates, as illustrated in FIG. 3, the strap ends extend substantially entirely across the upper and lower surfaces of these plates. Desirably, at least two of the preformed holes 24 in the ends of the strap 22 are aligned with each other at an oblique angle to the longitudinal axis of the strap such that when the strap ends have been bent over the top and sole plates of the stud wall, a line joining the centers of the aligned holes is substantially normal to the length of the respective plates. For example, if the longitudinal axis of the strap 22 makes an angle of 45° with the upright studs, then a line joining at least two adjacent holes at each end of the strap will be at approximately an angle of 45° to the longitudinal strap axis. This feature can best be seen in FIGS. 2 and 3 of the drawing.

In use, the strap 22 of the invention is placed diagonally against one side of the assembled stud wall with the ends 22.1, 22.2 of the strap projecting upwardly and downwardly, respectively, from the upper and lower surfaces of the top and sole plates 14, 16 of the stud wall. The ends 22.1, 22.2 are then manually bent inwardly of the stud wall, by hammering, so that the strap ends lie flushly against the respective upper and lower surfaces of the top and sole plates. The strap is then fastened rigidly to the stud wall plates by means of nails driven through the preformed holes 24 in the strap ends into the top and sole plates of the stud wall. Additional preformed holes 28, which are formed in the strap adjacent the strap ends 22.1, 22.2, receive nails driven therethrough into the edges of the top and sole plates. Finally, nails are driven through the preformed holes 26 along the length of the strap into the studs 18 which are crossed by the strap, as shown at 30 in FIGS. 1 and 3.

In use, the strap 22 acts primarily in tension to maintain the right-angle configuration of the studs with the top and sole plates of the stud wall. The braces of the invention ordinarily are applied to stud walls at locations near the corners of buildings, or where a stud wall abuts an outer wall of the building, the braces being oriented so that their upper ends which are affixed to the top plate are nearer the exterior wall, or corner of the building, than are the lower portions of the braces. Forces tending to cause the stud wall to sag outwardly thus are countered by the tensional strength of the strap 22. As a result of the bent-over configuration of the strap ends 22.1, 22.2, the nails which are employed to affix the strap ends to the top and sole plates of the stud wall are subjected to shear forces, rather than forces tending to pull the nails directly outwardly, when the stud wall is stressed. The bent, or "wrap around" orientation of the ends of the strap provide a large surface over which the strap may be fixed to the stud wall plates. The orientation of the nail holes 24 with respect to the length of a respective stud wall plate tends to prevent the bent-over ends 22.1, 22.2 of the strap from pivoting in the plane of the stud wall plates when the stud wall is stressed. The fastening, by nails, of the strap 22 to the studs 18 which it crosses provides additional support for the structure. The strap snugly bears against the edges of the stud wall plates and studs, and the flattened nature of the strap reduces or eliminates interference with wall board or other materials which subsequently may be mounted on the stud wall.

I have found that when a metal strap is diagonally affixed by nailing to the flat surface of a stud wall, as in U.S. Pat. No. 2,302,101, and the wall is then stressed by a racking load, several modes of failure are possible. Firstly, the metal strap may merely break in tension. Secondly, and more likely, the nails holding the strap to the studs and plates will bend and pull out, the wood at the nail holes becoming splintered. When, as in the present invention, both ends of the strap are bent over into flush engagement with the top and bottom surfaces of the top and sole plates, respectively, and there secured by nails, the tendency of nails to pull out or bend over is greatly decreased. The resulting resistance to deformation and to failure is increased up to 50% or more in comparison to straps in which one or both ends are not bent over and affixed to the top and sole plates.

At high values of racking stress, however, a stud wall strengthened with a metal strap according to the present invention may exhibit yet another mode of failure in which the bent over strap ends, at the points of bending, tend to bite into and crush the wood of the top and sole plates. Thus, failure may occur because of breakage or undue yielding of the strap, shearing or bending of the nails, and crushing of the wood of the top and sole plates.

For ease of shipping and handling, the strap employed in the present invention should be reasonably resistant to being bent or otherwise deformed; that is, the cross-sectional area of the strap should be reasonably large to provide resistance to deformation. Yet, a strap of great cross-sectional area will cause a stud wall braced with it to fail by crushing and splintering of the wood, and shearing of nails, and the strap will neither elongate nor break. In this situation, the strap is unnecessarily strong and heavy, and the strength of the thus-braced stud wall depends primarily upon the strength of the nails and wood and only secondarily upon the strength in tension of the strap.

Moreover, in accordance with the present invention the strap ends are normally hammered over the top and sole plates of a wooden stud wall at the job site by a carpenter. If the strap is unnecessarily strong and of large cross-sectional area, then the ends of the strap can be bent over the stud wall plates by hammering only with difficulty. The radius of the resulting bend is considerably larger than the radius of the ordinarily sharp edge of the plate over which the strap is bent, and the strap at its bend digs into and crushes the wood of the stud wall plate, thus preliminarily and often unpredictably weakening the stud wall.

It will now be understood that the metal straps employed in the present invention need not be of extremely heavy gauge steel, nor unusually wide. Optimum results may be obtained, from the combined standpoints of economy and strength, if the strap is chosen so that the strength limits of the wood, the nails and the strap are all closely approached when the stud wall is stressed to failure by a racking load. That is, at failure, the strap should show some elongation, some nail pulling or shearing should occur, and some crushing or damage to the wood (normally to the top and/or sole plates) should be observed. Yet, the stap should be sufficiently bendable so that its ends may be bent over by hammering into flush engagement with the upper and lower surfaces of the top and sole plates, respectively, with little or no crushing of wood and with the bends in the strap conforming closely to the edges of the top and sole plates over which the ends of the strap are bent. As will be shown below, I have found that hot-rolled steel, galvanized, of approximately 16 gauge and two inches in width, provides the optimum results referred to above.

EXAMPLE I

A series of test stud walls were prepared and tested in accordance with ASTM (American Society For Testing Materials) E 72. Each stud wall was prepared from construction grade 2 × 4 lumber, 8 feet in length and 8 feet high with a double top plate, double end studs and single sole plate. Each stud wall was tested in a racking load test after being braced with a metal brace. The metal braces, of varying thickness and width, were each 10 feet in length and were each manufactured from hot-rolled, galvanized steel. Braces of 14 gauge, 16 gauge and 18 gauge were tested, having widths of 1½ inches, 2 inches and 2½ inches. The majority of the braces had their ends hammered over the top and sole plates, in accordance with the broad aspect of the invention, with the bent-over ends of the braces being nailed to the upper and lower surfaces of the top and sole plates, respectively. Nails also were driven through preformed holes in each brace into studs which the brace crossed. Other braces were affixed to the stud wall without bending the ends of the braces; that is, the braces were affixed, by nailing, to the planar surface of the stud wall only. Yet other braces had but one end bent over and affixed to the outer surface of the stud wall plate. Racking load were applied to each of the stud wall specimens in accordance with ASTM-72 (a horizontal, measured force being applied in the plane of the stud wall to the top plate thereof). The force in pounds required to produce a deflection of 0.5 inches (measured in the direction of applied force) was reported, as well as the load a failure of the stud wall. Observations were made as to the bending of the ends of the braces over the top and sole plates of the stud wall, the mode of failure, and the elongation of the brace (in percent) was reported. Each test figure reported in Table I represents the average of three actual test measurements, except as otherwise noted. The ease with which the ends of the straps were hammered over the edges of the top and sole plates is reported on a 1–10 scale with 1 representing great ease of bending and 10 representing great difficulty in bending.

wall plate in comparison with bending neither end of the strap about the plate; compare test No. 13 with tests 10–12.

Table I further shows that failure of the stud walls supported by the 18 gauge straps occurs primarily because of elongation and ultimate failure of the strap itself, the strap failing before failure of the nails or wood. On the other hand, those stud walls which were braced with 14 gauge straps, 2 or 2½ inches in width, failed by failure of the nails or wood, the straps exhibiting little or no elongation at failure. The straps which were 1½ inches in width, and of various gauges, all failed by failure of the strap itself through elongation. Of the straps 2 inches in width, only the 16 gauge strap

TABLE I

| Test No. | Strap Gauge | Strap Width inches | Wrapped Strap Ends | Ease of bending ends, 1–10 scale | Load, lbs. 0.5 in. deflection | Ultimate strength, lbs. | Elongation at Failure, % | Remarks |
|---|---|---|---|---|---|---|---|---|
| 1 | 14 | 2 | Yes | 5, crushed plates | 1118 | 2684 | 0.146 | Plates badly crushed at failure, nails sheared and bent, insignificant strap elongation. |
| 2 | 16 | 2 | Yes | 4, very slight plate crushing | 1230 | 3131 | 0.604 | At failure: Plates crushed, nails bent and sheared, strap elongated. |
| 3 | 18 | 2 | Yes | 3, no crushing | 1118 | 2237 | 1.958 | Failure by strap yielding and necking down. No wood crushing nor bending of nails. |
| 4 | 14 | 1 ½ | Yes | 4, little crushing | 1375 | 2684 | 1.604 | Strap yielded & necked down at failure. Nails slightly bent and slight wood crushing. |
| 5 | 16 | 1 ½ | Yes | 3, no crushing | 900 | 2237 | 1.250 (a) | Failure by strap necking down and breaking. No bent nails. |
| 6 | 18 | 1 ½ | Yes | 2, no crushing | 1000 | 1789 | 1.667 | Strap necked down & yielded at failure. |
| 7 | 14 | 2 ½ | Yes | 6, badly crushed plates | 1350 | 3355 | 0.08 (a) | Nails bent and sheared, and pulled through wood. Plates badly crushed; bowed stud wall. |
| 8 | 16 | 2 ½ | Yes | 5, crushed plates | 1100 | 2900 | 0.027 | No necking down of strap at failure; sole plate crushed and nails sheared |
| 9 | 18 | 2 ½ | Yes | 4, no crushing | 1100 | 2684 | 1.495 | Wooden plates crushed, nails pulling out & bent. |
| 10 | 14 | 2 | No | — | 700 | 1118 | None | Nails bent and pulled out Strength dependent on nails and wood only. No elongation of strap. |
| 11 | 16 | 2 | No | — | Not measured | Not Measured | None | " |
| 12 | 18 | 2 | No | — | 484 (b) | 895 (b) | None | " |
| 13 | 16 | 2 | one end only | 4 | Approx same as Test No. 10 | Approx same as Test No. 10 | None | Ditto, no crushing; failed at straight end. |

(a) Average of two tests.
(b) Single test

Comparison of the strength data (both ultimate strength and load at 0.5 inches deflection) between tests 1–9 on the one hand and 10–12 on the other hand demonstrates the great benefit of my invention in wrapping both ends of the strap about the respective top and sole plates of a stud wall. Further, comparison of strength data of tests 1–9 (in which both ends of the strap were bent over the top and sole plates), 10–12 (in which neither end of the strap was bent) and 13 (in which only one end of the strap was bent over the plate) demonstrates that significantly higher strength results are obtained by wrapping both ends of the strap about the top and sole plates, respectively, in comparison to wrapping neither end, or only one end of the strap about a plate; further, no strength advantage is gained by bending one end of the strap about a stud showed failure due to some crushing of the wood, some bending and shearing of the nails, and also some elongation of the strap. The 14 gauge straps, 2 inches in width, badly crushed the wooden plates and exhibited little or no elongation whereas the 18 gauge straps of the same width failed by failure of the strap itself. Thus, the strap of 16 gauge steel, 2 inches in width, exhibited strength roughly matching that of the wood and nails; that is, at failure the top and sole plates were crushed somewhat, nails were bent and sheared, and the strap itself had elongated a significant amount. The ends of the 16 gauge straps, 2 inches wide, are easily bent about the top and sole plates on the job site by hammering without undue crushing of wood, and these straps can be readily shipped and handled without significant bending or other distortion. The 16 gauge straps, 2 inches in width, thus provide optimum results from the combined standpoints of economy and strength in comparison to straps of differing thickness or differing width.

As noted above, the ends of thes straps employed in the present invention have preformed holes therein permitting at least three and preferably four nails to be driven through the strap ends into the top and bottom surfaces of the top and sole plates, respectively. Reduction in the number of nails which affix the bent over strap ends to the respective stud wall plates results in a reduction of resistance to deflection, ultimate strength, and elongation of the strap since the strap ends become somewhat more easily moved with respect to the stud wall plates.

EXAMPLE II

Stud walls were prepared as in Example I above, and were braced with hot-rolled, galvanized steel straps of 16 gauge, 2 inches wide with the ends of the straps bent over the top and sole plates of the stud wall and there affixed to the top and sole plates with varying quantities of nails. The thus-braced stud walls were subjected to a racking load, as in Example I, and the following Table II reports the test result.

TABLE II

| Test No. | No. of Nails at each bent-over end | Load, lbs, 0.5 in. deflection | Ultimate Strength lbs. | Elongation at failure, % | Remarks |
|---|---|---|---|---|---|
| 14 | 1 | 1000 | 2200 | 0.09 | Nail bent & pulled out of plates, increased bend radius. |
| 15 | 2 | 1200 | 2237 | 0.115 | " |
| 16 | 3 | 1118 | 2684 | 0.209 | Ditto; noticeable strap elongation. |
| 2 | 4 | 1230 | 3131 | 0.604 | Nails bent & sheared, strap elongated. |

The stud wall and brace of the invention have been compared with a stud wall braced by wooden let-ins and have been found to be far superior in strength. One such test was a racking load test performed in accordance with ASTM E 72 and which compared a brace of the invention of 16 gauge hot-rolled, galvanized steel strapping, two inches in width, with 1 × 4 inch wooden let-in bracing. The load required to cause a one-half inch deflection in the stud wall braced with the brace of the invention was over 140 percent of the load required to provide the same deflection in a stud wall with wooden let-in bracing.

Manifestly, I have provided a stud wall and brace which is stronger and more resistant to deformation than stud walls braced with wooden let-in bracing or common steel straps.

While I have described a preferred embodiment of the present invention, it should be understood that various changes, adaptations, and modifications may be made therein without departing from the spirit of the invention and the scope of the appended claims.

What is claimed is:

1. In combination, a wooden stud wall for a building and the like and a diagonal brace for tensile loading for the wall to prevent the wall from sagging under a racking load, the stud wall having horizontally extending and vertically spaced top and sole plates between which are fastened spaced and upright studs, the wall having end studs between the terminal ends of the top and sole plates, the brace comprising an elongate and flat metal strap with a plurality of preformed holes spaced from each other along the length thereof, the metal strap extending continuously from the top plate to the sole plate and extending diagonally across the studs and the top and sole plates on one side of the stud wall and being nailed to each of the studs crossed and to the sides of the top and sole plates, the ends of the metal strap being bent over into flush engagement with the upper and lower surfaces of the top and sole plates and extending obliquely across such plate surfaces, the upper end of the metal strap being bent around the corner between the side and top surface of the top plate at a location closely adjacent the terminal end of the top plate, and the upper end of the strap lying on the top plate in superposed relation to the upper end of the end stud of the stud wall, and the upper and lower ends of the metal strap being secured flush against the plates by nails driven vertically through the preformed holes and solidly into the plates.

2. The invention according to claim 1 wherein the strap is of steel and the strap ends being manually hammered over the top and sole plates of the stud wall into flush engagement with the upper and lower surfaces of the stud wall plates without significant crushing of the plates.

3. The invention according to claim 1 and the preformed holes in the ends of the metal strap being arranged in a triangular relation, and each end of the metal strap defining a tapered apex with end edges oriented obliquely to each other and obliquely to each of the longitudinal side edges of the metal strap.

* * * * *